United States Patent [19]

Balaton

[11] Patent Number: 5,044,030

[45] Date of Patent: Sep. 3, 1991

[54] MULTIPLE LAYER FLUID-CONTAINING CUSHION

[75] Inventor: James I. Balaton, Des Plaines, Ill.

[73] Assignee: Fabrico Manufacturing Corporation, Chicago, Ill.

[21] Appl. No.: 534,173

[22] Filed: Jun. 6, 1990

[51] Int. Cl.[5] ..... A47C 27/10

[52] U.S. Cl. ..... 5/455; 5/451; 297/DIG. 3

[58] Field of Search ..... 5/457, 455, 441, 449, 5/450, 451, 456; 441/129; 297/DIG. 3

[56] References Cited

U.S. PATENT DOCUMENTS

| | | | |
|---|---|---|---|
| 2,604,641 | 7/1952 | Reed | 5/455 |
| 2,612,645 | 10/1952 | Boland | 5/441 |
| 2,731,652 | 1/1956 | Bishop . | |
| 2,842,783 | 7/1958 | Druck | 5/457 |
| 3,030,640 | 4/1962 | Gosman | 5/455 |
| 3,112,956 | 12/1963 | Schick et al. | 5/455 |
| 3,192,540 | 7/1965 | Swank . | |
| 3,253,861 | 5/1966 | Howard . | |
| 3,585,661 | 6/1971 | Gottfried et al. . | |
| 3,605,145 | 9/1971 | Graebe . | |
| 3,616,471 | 11/1971 | Braun | 5/450 |
| 3,689,949 | 9/1972 | Weinstein et al. | 5/451 |
| 3,721,232 | 3/1973 | Trenchard | 128/68 |
| 3,848,282 | 11/1974 | Viesturs | 5/451 |
| 3,870,450 | 3/1975 | Graebe | 425/269 |
| 3,872,525 | 3/1975 | Lea et al. | 5/450 |
| 3,935,690 | 2/1976 | Lea et al. . | |
| 4,025,974 | 5/1977 | Lea et al. | 5/450 |
| 4,073,021 | 2/1978 | Carlisle | 5/450 |
| 4,132,228 | 1/1979 | Green | 128/33 |
| 4,370,769 | 2/1983 | Herzig et al. | 5/455 |
| 4,382,306 | 5/1983 | Lickert | 5/449 |
| 4,389,742 | 6/1983 | DeWitt | 5/455 |
| 4,391,009 | 7/1983 | Schild | 5/455 |
| 4,541,136 | 9/1985 | Graebe | 5/455 |
| 4,547,919 | 10/1985 | Wang | 5/455 |
| 4,588,229 | 5/1986 | Jay | 5/450 |
| 4,624,877 | 11/1986 | Lea et al. | 5/449 |
| 4,639,960 | 2/1987 | Quillen et al. | 5/455 |
| 4,643,481 | 2/1987 | Saloff et al. | 5/436 |
| 4,685,163 | 8/1987 | Quillen et al. | 5/455 |
| 4,698,864 | 10/1987 | Graebe | 5/455 |
| 4,724,560 | 2/1988 | Christie | 5/451 |
| 4,726,624 | 2/1988 | Jay | 5/451 |
| 4,730,610 | 3/1988 | Graebe | 128/149 |

FOREIGN PATENT DOCUMENTS

| | | | |
|---|---|---|---|
| 918227 | 9/1954 | Fed. Rep. of Germany . | |
| 1274076 | 9/1961 | France | 5/457 |
| 302008 | 12/1928 | United Kingdom . | |
| 340506 | 12/1930 | United Kingdom . | |
| 439936 | 12/1935 | United Kingdom . | |
| 978348 | 12/1964 | United Kingdom . | |
| 1302522 | 1/1973 | United Kingdom . | |
| 2026315 | 2/1980 | United Kingdom . | |
| 2074034 | 10/1981 | United Kingdom . | |
| 2082907 | 3/1982 | United Kingdom | 5/451 |
| 2105984 | 4/1983 | United Kingdom . | |

*Primary Examiner*—Alexander Grosz
*Attorney, Agent, or Firm*—Dressler, Goldsmith, Shore, Sutker & Milnamow, Ltd.

[57] ABSTRACT

A cushion is provided with a flexible wall means for defining a plurality of elongated, parallel, flexible tubes for containing fluid. The tubes include a middle row of tubes positioned between a top and bottom row of tubes. The tubes in each row are in internal communication with each other in the respective row. The middle row of tubes may be offset from the top and bottom row of tubes, and flow paths may be provided for establishing communication between at least two of the rows of tubes.

1 Claim, 3 Drawing Sheets

MULTIPLE LAYER FLUID-CONTAINING CUSHION

TECHNICAL FIELD

This invention relates to a fluid-containing device for supporting a body or portion of a body. The invention is particularly adapted for use as a mattress, mattress overlay, seat cushion, back support cushion, or as part of a splint assembly for cushioning or immobilizing a portion of a body.

BACKGROUND OF THE INVENTION AND TECHNICAL PROBLEMS POSED BY THE PRIOR ART

Various types of conventional mattresses and seat cushions have been introduced or proposed for providing a reduced pressure on the body and/or for providing a desired pressure distribution and/or pressure relief on the common bony prominences.

Such mattresses and cushions are typically intended for use by partially or completely immobilized patients who maintain a substantially stationary position for long periods of time. Cushions have been specifically designed for use as a seating cushion or back support cushion for a patient when seated in a chair, especially a wheelchair. A variety of these designs are in use or have been proposed which are intended to overcome some of the problems encountered by the patient.

For example, when a person is sitting on a cushion or lying on a mattress, the person's weight is concentrated to a great extent on the bony prominences. In the buttock area the pressure tends to be greatest in the ischial, trochanter, and sacral areas. In the supine position the pressure points are the scapula, elbow, sacrum, greater trochanter, ischial tuberosity, and heel areas. Excessive pressure on these areas for prolonged periods of time can result in restricted circulation of blood and in tissue necrosis with the resultant formation of pressure sores or decubitus ulcers.

Another problem that must be addressed by an effective mattress or cushion design is the stability of the body when placed on or against it. This is especially important with a seat cushion. To the extent that a patient may tilt, lean, or otherwise actually shift position on the cushion, there is a danger that the response of the cushion may be inconsistent with the maintenance of the desired stability. For example, a cushion containing an unregulated body of fluid may not provide sufficient resilience or resistance to movement.

Some cushions contain relatively large amounts of liquid, and this can make the cushion relatively heavy and difficult to handle, especially for elderly, infirm, or disabled persons.

With almost any cushion design, cost considerations are important. A cushion having a complex design may be difficult to manufacture, and may therefore be too costly to be of practical use.

In view of the above-discussed problems, it would be desirable to provide a body support device with improved features and support characteristics and which could still be relatively inexpensively manufactured.

It would be beneficial if such an improved support device would provide sufficiently low pressures on the body so that the device would be useful in preventing or treating pressure sores. To this end, the improved device should at least comfortably support the body device with a minimal, or at least reduced, tendency to cause tissue stress and resultant pressure sores.

It would be advantageous if such an improved device could be used in a way that would permit the device to readily and effectively conform substantially to the contour of the body portion engaged with the device.

In addition, it would be desirable to provide an improved device which could support a body or portion thereof in a relatively stable manner while still being capable of accommodating the movement or repositioning of the body.

It would also be beneficial if the design of the improved device could accommodate fabrication from relatively light weight components so that the overall weight of the device is not excessive.

SUMMARY OF THE INVENTION

According to the broad principles of one aspect of the present invention, a cushion, which can be used as a mattress overlay, a support cushion, or the like, is provided with at least three fluid-containing chambers including a flexible top chamber, a flexible bottom chamber, and a flexible middle chamber disposed generally between the top and bottom chambers.

Each chamber includes a plurality of interior channels or tubes arranged in a row and arranged in communication within that chamber to define flow paths.

In one embodiment, all three of the chambers are in fluid communication, in another embodiment two of the chambers are in fluid communication, and in still another embodiment each of the three chambers is completely separated from communicating with either of the other two chambers.

In a preferred embodiment, a flexible wall means is provided for defining the tubes, and it extends on one or both ends of the cushion for permitting communication between the ends of the tubes in each row. Further, in one embodiment, each top row tube is substantially in vertical registry with, and adjacent to, one of the bottom row tubes at an interface region to define a vertically registered pair of tubes. Each middle row tube is laterally offset from an adjacent pair of vertically registered top and bottom row tubes and is nested relative to the adjacent pair.

Valve means are provided for preventing or permitting flow of fluid through the valve means into and out of the tubes.

In a preferred embodiment, the flexible wall means includes four sheets of fluid-impervious, thermoplastic material arranged in four, generally superposed layers. The four sheets are sealed together at the cushion periphery with the pairs of adjacent sheets also being sealed together along spaced-apart parallel lines within the periphery to define the top, middle, and bottom rows of tubes. The parallel line seals terminate short of the peripheral seal at one end of the cushion to provide communication between the tubes in each row.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

FIG..5 is a view similar to FIGS. 3 and 4 but showing a second modification.

DESCRIPTION OF THE PREFERRED EMBODIMENTS

While this invention is susceptible of embodiment in many different forms, this specification and the accompanying drawings disclose only some specific forms as examples of the use of the invention. The invention is not intended to be limited to the embodiments so described, and the scope of the invention will be pointed out in the appended claims.

The article of this invention has certain structural details and mechanical elements that will be recognized by one skilled in the art. However, the detailed descriptions of such elements are not necessary to an understanding of the invention, and accordingly, are not herein presented.

Figure 1:
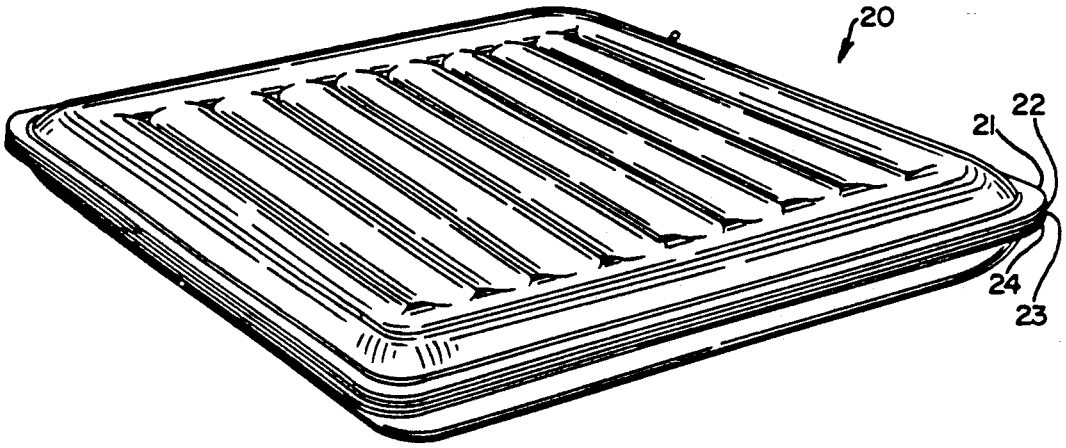
FIG. 1 is a perspective view of a preferred embodiment of a cushion of the present invention adapted for use as a seat cushion.

Referring now to the drawings, a first embodiment of the device of the present invention is designated generally by reference numeral 20 in FIG. 1. The device 20 is specifically configured for use as a cushion or mattress for supporting a reclining person. As used in this specification and the claims, the term "cushion" includes a cushion of the type that can function as a mattress or mattress overlay for a reclining person or as a seat cushion or back cushion for a seated person. The cushion may also function separately as a support for a person's limb or limbs, including as part of a splint assembly.

Figure 3:
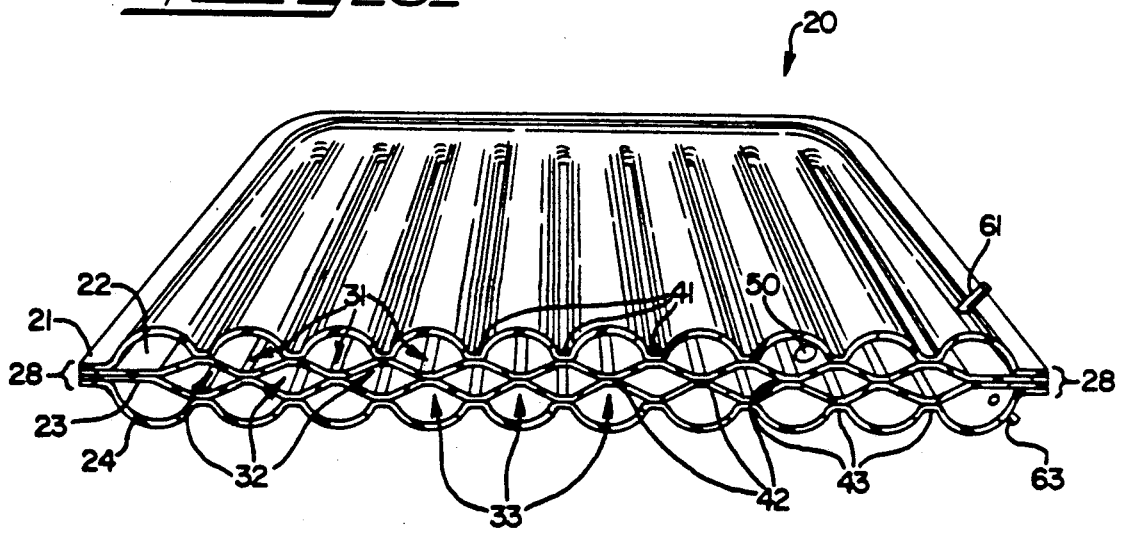
FIG. 3 is a fragmentary, enlarged, perspective view of the cushion showing interior structural details.

As best illustrated in FIG. 3, a preferred construction of the cushion 20 employs four sheets 21, 22, 23, and 24 of a fluid-impervious, thermoplastic material arranged in four, generally superposed layers. Any suitable, flexible, fluid-impervious material may be used, but it is advantageous to use a thermoplastic material which can be sealed (e.g., by heat sealing), which is impervious to many filling fluids that might be used, and which is relatively inexpensive. The thickness of the sheets 21, 22, 23, and 24 may be the same or different.

These sheets may be fabricated from a variety of conventional or special materials. This could include an elastomeric polymer. For example, one such polymer would be a suitable polyurethane film material sold under the trade name "DUREFLEX" in the United States of America by Deerfield Urethane, Inc., P.O. Box 186, South Deerfield, Mass. 01373, U.S.A. Preferably, the material used for the sheets, 21, 22, 23, and 24 is heat sealable so that a peripheral seal 28 can be provided around the edge or margin of the cushion 20. Other means, such as adhesive, could be used for securing the sheets together at the periphery of the cushion 20 and elsewhere.

The sheets 21, 22, 23 and 24 may be characterized in combination as a flexible wall means for defining a plurality of elongated, parallel, flexible channels, passages, pockets, compartments, or tubes 31, 32, and 33. As best illustrated in FIG. 3, the tubes 31 are arranged in a top row, the tubes 32 are arranged in a middle row, and the tubes 33 are arranged in a bottom row.

As illustrated in FIG. 3 for a preferred embodiment, each top row tube 31 is substantially in vertical registry with, and adjacent to, one of the bottom row tubes 33 at an interface region so as to define a vertically registered pair of tubes. Each middle row tube 32 is laterally offset from an adjacent pair of vertically registered top and bottom row tubes and is nested relative to the adjacent pair.

In particular, with continued reference to FIG. 3, the top row of tubes 31 is formed by sealing the pair of adjacent sheets 21 and 22 together along spaced-apart parallel lines 41. The middle row of tubes 32 is formed by sealing the adjacent sheets 22 and 23 together along spaced-apart parallel lines 42. The bottom row of tubes is formed by sealing together the pairs of adjacent sheets 23 and 24 along spaced-apart parallel lines 43.

In one embodiment, the seal lines 41, 42, and 43 forming the tubes need not extend completely from one end of the cushion to the other end. For example, in the embodiment illustrated in FIGS. 1–3, the seal lines 41, 42, and 43 terminate short of the peripheral seal at each end of the cushion 20 so as to provide communication between the tubes in each row. That is, all of the tubes 31 are in communication at each end in the top row but do not communicate with the middle row tubes 32 or bottom row tubes 33. All of the middle row tubes 32 communicate at each end in the middle row but do not communicate with the top row tubes 31 or the bottom row tubes 33. Similarly, all of the tubes 33 communicate at each end of the cushion 20 in the bottom row but do not communicate with the middle row tubes 32 or top row tubes 31.

Figure 6:
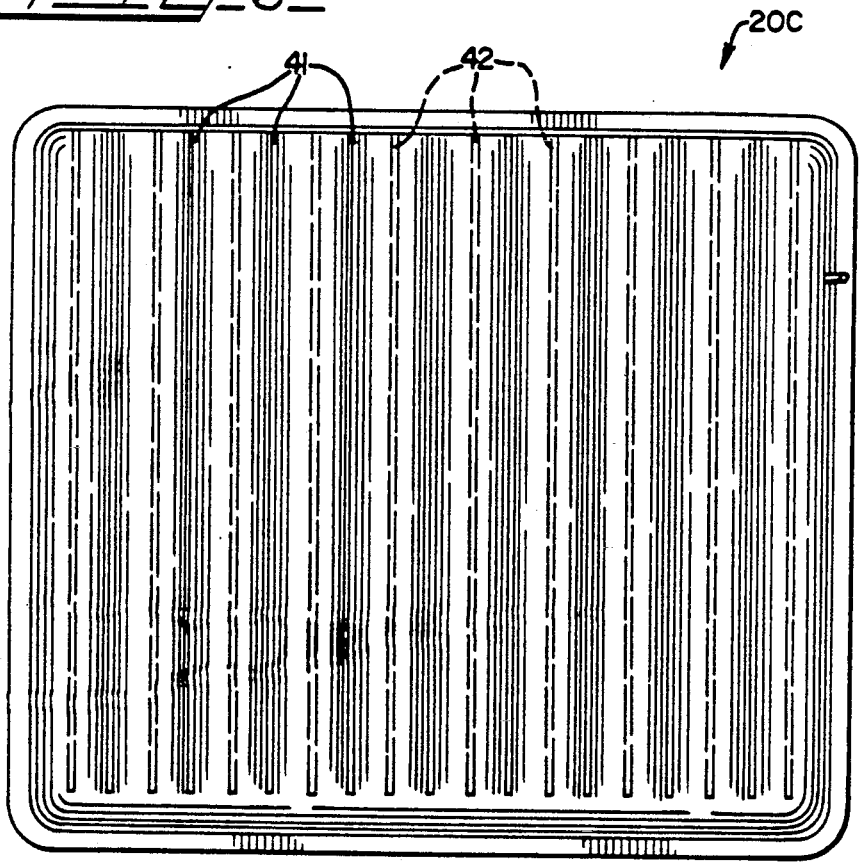
FIG. 6 is a view similar to FIG. 2 but showing an alternate seam construction.

In a modification of the cushion 20C shown in FIG. 6, the longitudinal tube seals 41, 42, and 43 may be extended all the way to one end so that the tubes in each row communicate at the ends of the tubes only along the other end of the cushion 20C.

Because the tubes in each row are not sealed at least at one end of the cushion 20 or 20C, each row of tubes, including the open portions at the end or ends, may be characterized as a chamber Thus, the volume between the sealed pair of sheets 21 and 22 can be defined as a top chamber, the volume between the sealed pair of sheets 22 and 23 can be defined as the middle chamber, and the volume between the pair of sheets 23 and 24 can be defined as the bottom chamber. Each chamber can then be characterized as including a plurality of interior tubes arranged for communication to define flow paths within that chamber.

Figure 2:
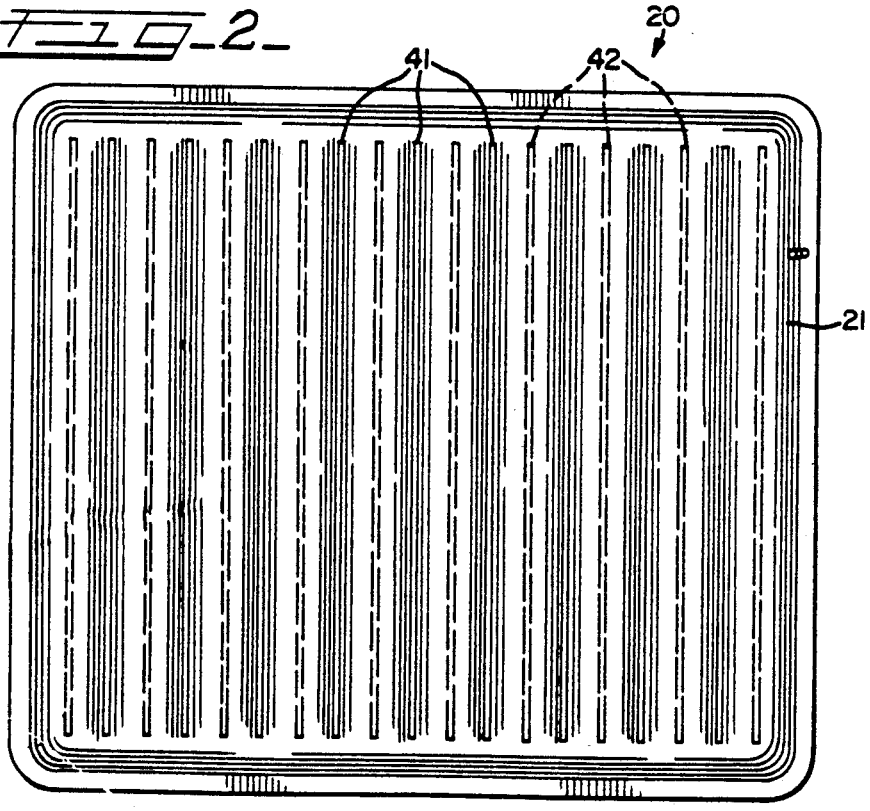
FIG. 2 is a plan view of the cushion.

In a preferred embodiment of the cushion 20 illustrated in FIGS. 1–3, the second sheet 22 is provided with an aperture or orifice 50 to provide communication between the top chamber tubes 31 and the middle chamber tubes 32. Further, the top chamber is provided with a valve means or valve 61 for preventing or permitting flow of fluid into and out of the top chamber. Similarly, the bottom chamber is provided with a valve means or valve 63 for preventing or permitting flow of fluid into and out of the bottom chamber. Any suitable or conventional special valve may be used for this purpose. One conventional valve that may be used is the insertion valve sold under the designation #160AC in the United States of America by Halkey-Roberts, 11600 Ninth St., N. St. Petersburg, Fla. 33702 U.S.A.

The top and middle chambers are filled through valve 61 with a suitable fluid, such as a gas, a liquid, or a liquid-type material such as conventional, highly viscous plastic or thixotropic materials that are flowable under pressure, as well as gels, jellies, and the like. The fluid introduced into the top chamber through the valve 61 also flows through the aperture 50 into the middle chamber. The bottom chamber may be filled with the same fluid or a different type of fluid through the valve 63.

When the cushion 20 is used, the weight force created by the seated or reclining body causes a distortion or flexing of the tube walls so that the contacting portions of the cushion substantially conform to, and accommodate, the body with reduced pressure. Some amount of the fluid can be relatively quickly displaced from portions of the three chambers. The resulting displacement of fluid occurs among tubes in each row and between the top and middle chambers. Flow resistance and restriction is provided by the longitudinal seals between the tubes and by the aperture 50.

The bottom chamber, having an independent fluid pathway in the bottom tubes 33, complements the action of the middle row tubes 32 and top row tubes 31. Movement or shifting of a body on the top chamber produces a relatively immediate adjustment within all of the chambers to maintain the desired reduced pressure and flotation effect. The pressure against bony prominences or other potential pressure sore regions of the body is significantly reduced.

Figure 4:
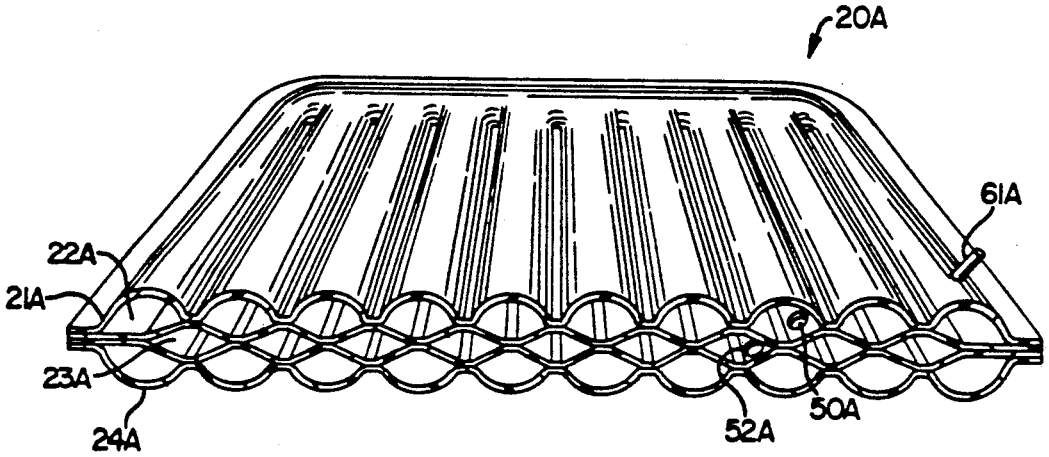
FIG. 4 is a view similar to FIG. 3 but showing a first modification.

FIG. 4 illustrates an alternate embodiment of the cushion 20A which is similar to the cushion 20 illustrated in FIGS. 1-3. The cushion 20A includes four sheets 21A, 22A, 23A, and 24A for three rows of tubes as in the cushion 20A. A first aperture 50A is provided in the second sheet 22A to provide communication between the upper chamber tubes and the middle chamber tubes. Further, and unlike the cushion 20, the cushion 20A includes an additional aperture 52A defined in the sheet 23A to effect communication between the middle chamber tubes and the bottom chamber tubes. As in the first cushion 20, the tubes in each row of the cushion 20A are open at least at one end of the cushion so that a tube in a row communicates with all of the other tubes in that row.

Because the tubes in the top row chamber are in communication through aperture 50A with the tubes in the middle row chamber, and because the tubes in the middle row chamber are in communication through aperture 52A with the tubes in the bottom row chamber, only one valve 61A is provided for filling the cushion 20A with the desired fluid. Of course, since all three rows of tubes are in communication, only a single, common fluid can be used. However, owing to the flow paths around the ends of the tubes and through the apertures 50A and 52A, the cushion 20A has the capability for conforming to the surface of a body engaged therewith and for accommodating movement or shifting of the body while providing reduced pressures and an increased flotation effect.

Figure 5:
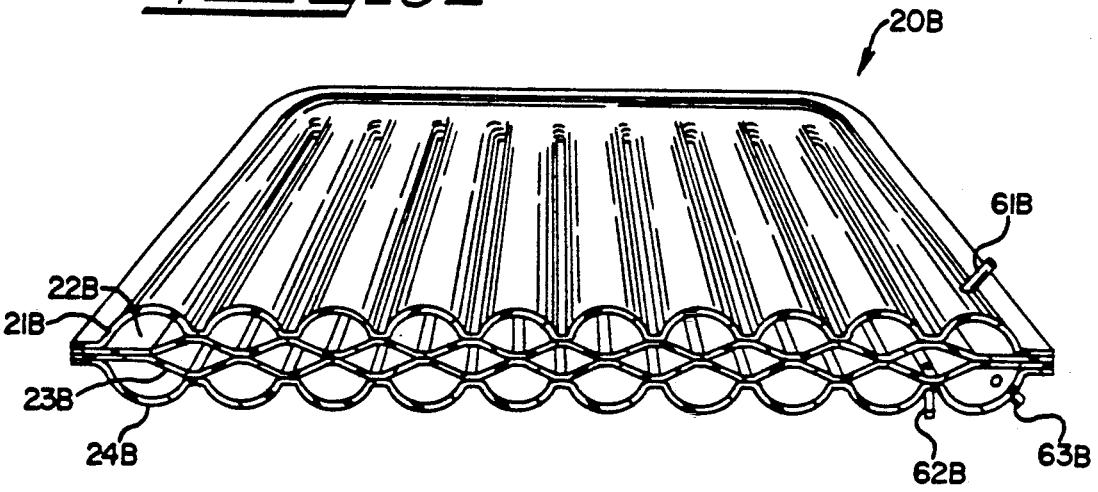

FIG. 5 illustrates still another alternate construction of the cushion wherein the cushion is designated therein by reference numeral 20B. The cushion includes four sheets 21B, 22B, 23B, and 24B. None of the sheets is provided with internal apertures, and thus there is no fluid communication between the top chamber, middle chamber, and bottom chamber. Each of the chambers must be independently filled with fluid through suitable valves 61B, 62B, and 63B. However, even though each chamber is independent of the other two chambers, the tubes in each chamber are open at least at one end of the cushion 20B so that there is communication between all of the tubes in that one chamber. This structure accommodates a certain amount of displacement of the fluid from one tube to another within the same chamber so that the cushion 20B more readily conforms to a contacting body and provides reduced pressure and increased flotation while also accommodating movement or shifting of the body.

Additional rows of tubes could be provided above and below the three rows of tubes illustrated in the preferred embodiment. Such additional rows of tubes may be in fluid communication with one or more of the rows of illustrated tubes or may be completely separated from the three rows of tubes. Other covering membranes, casings, pads, or cushions may also be employed depending upon the particular requirements of the application for which the device is intended. Further, the novel cushion structure may be combined with other types of support devices or cushion devices.

Although the embodiments of the cushion have been illustrated as being fabricated from separate sheets of material, the cushion or portions thereof may be initially fabricated with a unitary wall structure, as by extruding or drilling a tube configuration, and then providing appropriate seals.

It will be realized that modifications may be made to the invention described herein without departing from the essential spirit and scope. The following claims are intended to encompass all such modifications.

What is claimed is:

1. A fluid-containing cushion comprising:

at least three flexible chambers or containing fluid, said chambers including a top chamber, a bottom chamber, and a middle chamber disposed generally between said top and bottom chambers;

each said chamber including a plurality of interior flexible tubes arranged for communication to define flow paths within hat chamber;

said tubes in each said chamber being elongated and arranged in a parallel orientation in a generally horizontal row;

flexible wall means for defining said tubes and including four sheets of a fluid-impervious, thermoplastic material arranged in four, generally superposed layers;

said four sheets being sealed together at the cushion periphery with pairs of adjacent sheets also being sealed together along spaced-apart parallel lines within the periphery to define top, middle, and bottom rows of said tubes;

said parallel lines of sealing terminating short of the peripheral seal at two opposite ends of said cushion to provide communication between said tubes in each row at each end of the cushion;

each said tube in said top chamber being in substantially vertical registry with, and adjacent to, one of said tubes in said bottom chamber at an interface region to define a vertically registered pair of tubes;

the tubes in said middle chamber being laterally offset from an adjacent pair of vertically registered top and bottom chamber tubes and being nested relative to said adjacent pair;

said middle chamber communicating with one of said top and bottom chambers; and said middle chamber and said one top or bottom chamber containing a first fluid while the remaining chamber contains a second fluid that is different from said first fluid.

* * * * *